US005440071A

United States Patent [19]

Johnson

[11] Patent Number: 5,440,071

[45] Date of Patent: Aug. 8, 1995

[54] DYNAMIC CHORD INTERVAL AND QUALITY MODIFICATION KEYBOARD, CHORD BOARD CX10

[76] Inventor: Grant Johnson, 5025 Deerpark Cr., Fair Oaks, Calif. 95628

[21] Appl. No.: 19,137

[22] Filed: Feb. 18, 1993

[51] Int. Cl.[6] ..... G10H 7/00; G10H 1/38

[52] U.S. Cl. ..... 84/637; 84/645

[58] Field of Search ..... 84/610, 613, 626, 634, 84/637, 645

[56] References Cited

U.S. PATENT DOCUMENTS

| | | | |
|---|---|---|---|
| 3,889,568 | 6/1975 | Amaya . | |
| 4,389,914 | 6/1983 | Uetrecht et al. | 84/669 |
| 5,099,738 | 3/1992 | Hotz | 84/617 |
| 5,223,655 | 6/1993 | Watanabe et al. | 84/637 |

*Primary Examiner*—William M. Shoop, Jr.
*Assistant Examiner*—Jeffrey W. Donels
*Attorney, Agent, or Firm*—Alfred A. Equitz; Limbach & Limbach

[57] ABSTRACT

The Chord Board is a revolutionary musical instrument that simplifies and expands on the traditional piano-style keyboard interface through the use of computer technology. Musicians skilled or unskilled alike will be able to take advantage of this new musical interface which makes the playing of an unlimited variety of chords and their respective note patterns not only possible, but easy. Yet the design of the Chord Board allows for an extremely complex performance from a musician who has the ability and skill to make such a performance. The Chord Board is designed to maximize the potential for the introduction of the human element into the musical performance. The player interface of the Chord Board departs significantly from the traditional piano. There are eight banks of eight keys each, three for the left hand, and five for the right hand. These keys are similar in size and shape to the traditional piano-style key, yet there are no black keys in between the white keys. Each of these piano-like keys is mapped to a specific note of a chord grouping. Therefore, it is only possible to play notes that belong to a particular chord, eliminating the possibility of playing an accidental. The chord grouping is selected from an adjacent set of chord selection buttons some of which may be selected simultaneously as modifiers, providing for well over a hundred variations of chord structure within a single chord family. Because the Chord Board is also a full-fledged MIDI controller, the instrument is not limited to a particular niche, but may be used in a variety of musical applications.

15 Claims, 9 Drawing Sheets

DYNAMIC CHORD INTERVAL AND QUALITY MODIFICATION KEYBOARD, CHORD BOARD CX10

BACKGROUND

1. Field of Invention

The present invention relates to musical instruments, specifically to an electronic keyboard with a design significantly different from a piano keyboard so that a large variety of chord groupings and note patterns can be played with little or no skill.

2. Description of Prior Art

Ever since the invention of the electronic keyboard or organ, several inventors have expanded upon the original musical instruments to provide for the more-or-less automatic playing of certain chord groupings with the touch of a single key. One of the reasons for this feature being invented was so that novice keyboardists could play something that sounds difficult and meaningful with little or no skill. It reduced the skill level for play of some chords down to playing one key at a time. As one skilled in the art will appreciate, the development of legitimate chord playing skills on a piano-like keyboard typically takes several years to master. For this reason, the ability to play a complex chord with a single key became a novel and attractive feature to many novice keyboardists. The sound of the chord groupings is usually impressive and more pleasing to the ear than just a monophonic performance.

One of the problems with this one key approach, however, is that the chord grouping is fixed, and quickly becomes redundant. To overcome this, additional inventions were subsequently created to provide for the rhythmic and syncopated playing of the notes within the chord group, commonly known as a band-in-a-box feature on many keyboards and organs today. Although this feature or capability is somewhat interesting and has several varieties of rhythms from which to choose, it is still very inflexible for a live or professional performance. For example, the tempo of the rhythm is manually set and therefore the tempo of the song is static. Such a performance could not accommodate a pause or ritard in the musical score. A person playing such an automatic instrument could not follow a conductor or make dynamic modifications to the tempo. The use of such a feature in conjunction with other musicians is difficult, because all must follow the tempo of the band-in-a-box, and there is no practical ability to re-synchronize on the fly should the need arise.

In later years, inventions such as the apparatus of U.S. Pat. No. 4,389,914 issued Jun. 28, 1983 to inventors Dale M. Uetrecht and Carlton J. Simmons, Jr., provided for ways to identify the logically associated chord group by determining the root of the chord from the keyboardist's performance. This particular feature was to enhance the simple playing of a single line melody with associated chord accompaniment. This feature could also accommodate normal playing of a plurality of notes simultaneously, and determining the root of the chord, and then voicing additional notes related to the chord group. Although this was a singular idea, it still did not provide any flexibility to the choice of notes being played within the particular chord group, or how to loud play them, or what kind of syncopation or note rhythm would be used.

The present chord-playing technology available on the retail market lacks the means to introduce the human element commonly associated with such playing dynamics known as key velocity, tempo and pedal. Other human elements would include the absence of notes within the chord group being played, as well as a choice of which notes within the chord group to play. In addition, there has been no capability provided to dynamically change the chord note rhythm pattern, or to make it even determined by the keyboardists playing style. The ability to have dynamic control over these various elements has been virtually non-existent. One of main reasons for these limitations has been related to the object of these inventions striving to remain backwards-compatible with the typical piano keyboard interface. By so limiting, the voicing of various chord groupings by computer assistance have been limited to the playing of one key for each chord group.

Some inventors have even gone as far as to create a dual function for a selected portion of the keyboard or organ register so as to enable the playing of a unique chord group with a single key. The dual purpose of the key is typically defined by some physical indicator adjacent to the key itself. For example, if the key is to play a C minor 7th chord, then this label is typically printed adjacent to the key or is illuminated adjacent to the key when active. A toggle switch is typically employed to change the function of the keyboard register. The problem with this approach is that it limits the use of the keyboard register to only one of its functions at a time. The chords feature can not be utilized without disabling an important part of the keyboard for normal playing, and vice versa.

It was not until the invention of the HOTZ MIDI Translator, U.S. Pat. No. 5,099,738, that a technology was introduced which would allow human choice in selectively playing one or more notes within a chord grouping without the possibility of playing a wrong note. Even so, this correct note technology stops short in its implementation because of its lack of attention to experimental flexibility needed by musicians. Specifically, it can not allow for musical experimentation with chord structure. One must access a computer menu with a mouse device, and select a specific chord, such as D flat minor Augmented, and then assign it to the appropriate zone on the keyboard device. The computer program then assigns the contents of a look-up table for the specific chord to the keys on the keyboard. This complex process does not allow creative experimentation in a timely sense. There is no ability to utilize more than one function at a time to dynamically vary the chord structure. One can merely select a specific chord name from a long laundry list of chord names. This is essentially no different than the current implementation on modem devices such as the player-organs or keyboards where numerous, but static chord possibilities may be selected or accessed. The prior art lacks a keyboard device that can play correct notes within a selected chord group, but also dynamically and directly modify the chord structure pertaining to its quality, interval, octave or scale during a live musical performance.

OBJECTS AND ADVANTAGES

Accordingly, several objects and advantages of my invention are:

a) The keyboard functions of the present invention as well as the layout of keys lends itself to the playing of simple or complex chords, with the ability to play all or any portion of the chord group.

b) The keys on the keyboard of the present invention are individually associated with a specific note from the selected chord group. This relationship of keys to certain notes is a variable one, in that by pressing certain chord buttons or combinations of chord buttons the note assignments will change.

c) The chord grouping is user-selectable, and may be changed dynamically during performance. This feature yields nearly unlimited variety and control in chord composition and playing with a limited amount of keyboard keys.

d) A person with small hands can play chord groupings on the present invention that would require very large and skilled hands to play the same chord grouping on a piano.

e) A person with small or large hands can play complex and impressive sounding chords with a great degree of flexibility in how the chord group will be voiced. This flexibility is related to the rhythm f) A music composer with little or no knowledge of chord groupings, will be able to very quickly find a compatible chord to match the melody of their composition as nearly all variations for chord groupings are user selectable. Typically this trial and error process of finding the right chord grouping during composition or arrangement takes some time, with the result often being that the train of thought of the composer is lost due to distraction or frustration.

The Chord Board offers great advantage in quickly identifying the combination of chord intervals and quality that yield the type of emotion that a musician desires to elicit, with the combined ability to play selective and correct notes within the chord group or family.

Further objects and advantages are that a person with very little skill can play complex chord groupings that, from the hearer's perspective, would sound as if they were played authentically by one having skill on a conventional keyboard or piano. This is because of the human element that is introduced naturally by virtue of the capability or function of this new instrument. This is also because there are 8 keys assigned to each chord grouping, with each key associated with a unique note in the chord group, which offers nearly unlimited variety in playing style. The present invention significantly reduces the repetitious, limited, and somewhat inflexible chord playing patterns imposed by some of the typical band-in-a-box features found on today's organs or keyboards. In fact, the present invention accommodates hundreds of playing styles that are completely subject to the musical and rhythmical whims of that person playing it. The musician that would play the present invention would not be limited to a select group of preset functions, such as is the case with nearly all band-in-a-box features found today, but they would have the creative freedom to do their own thing.

Another advantage of the present invention is that this musical instrument is also a very sophisticated MIDI Controller, so that it is possible to play the same complex chords through external sound modules and interface with computers that are equipped with MIDI hardware and software. Because of this MIDI computer interface, the complex and intelligent musical information produced by this musical instrument can be heard on very high quality external sound modules. It will sound as professional as the sound equipment being used.

Yet another advantage of the present invention is that it has touch activated lighted keys that are color coded to the chord family group, so that playing the instrument in areas with limited lighting is very easy. This colored lighting scheme will also contribute to an accelerated learning curve for retention of chord grouping memorization.

Further objects and advantages of my invention will become apparent from a consideration of the drawings and ensuing description. These will include the efficiency of the design and layout of the various elements of the Chord Board, as well as ergonomics.

DRAWING FIGURES

Figure 3:
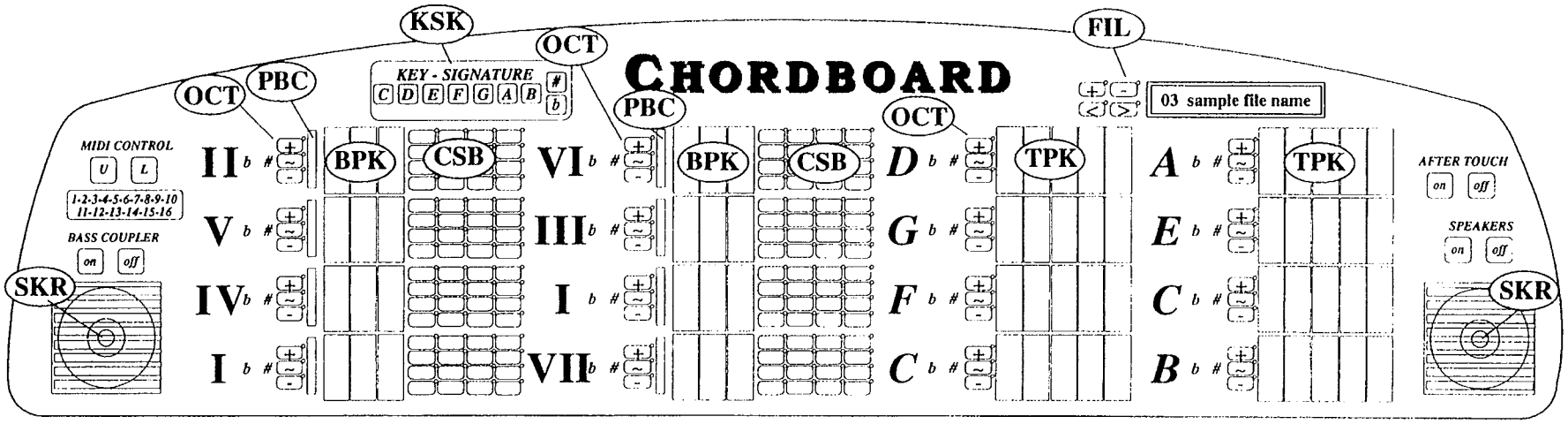

FIG. 3 identifies the main groupings of the Chord Board

Figure 4:
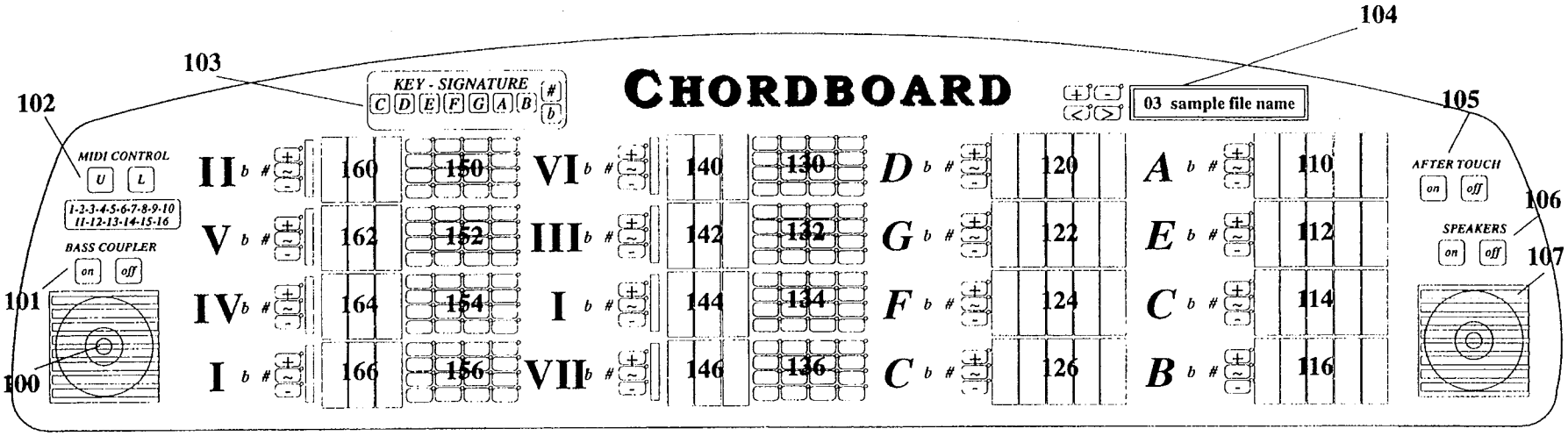

FIG. 4 shows several sub-groups of parts and controls on the Chord Board.

Figure 5:
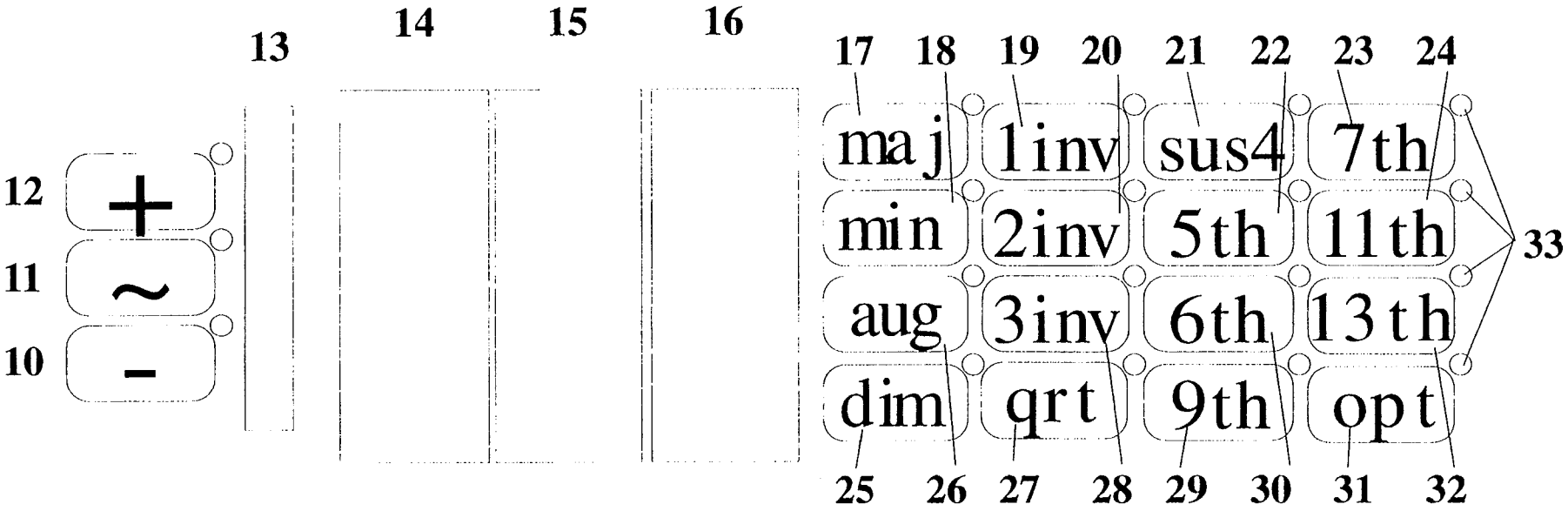
Figure 6:
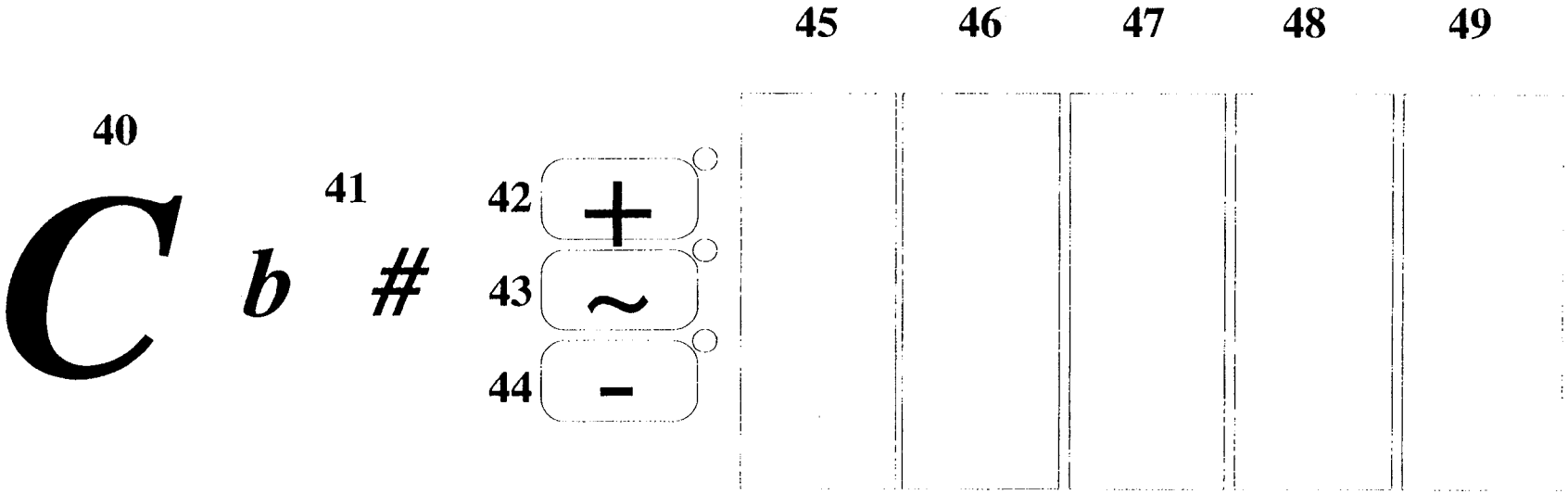
Figure 7:
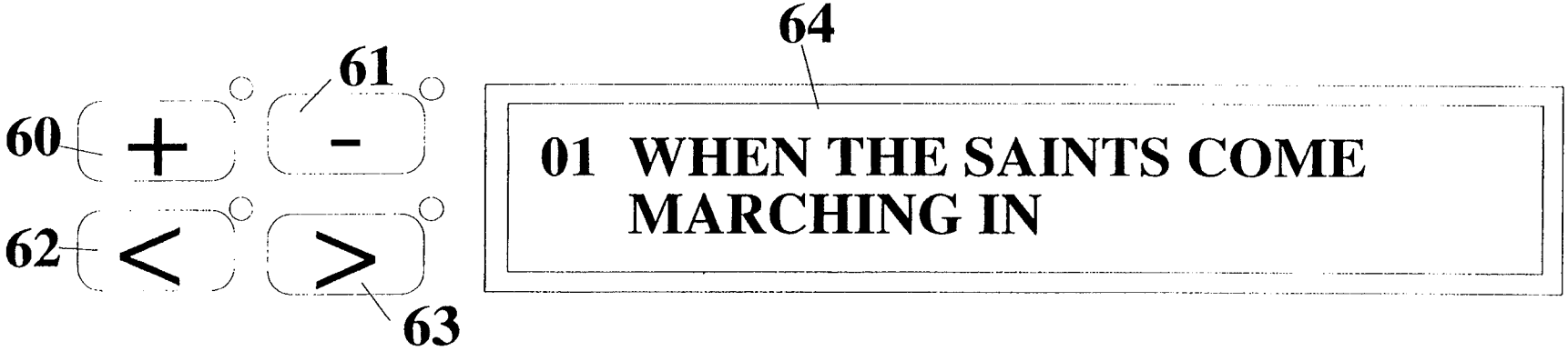
Figure 8:
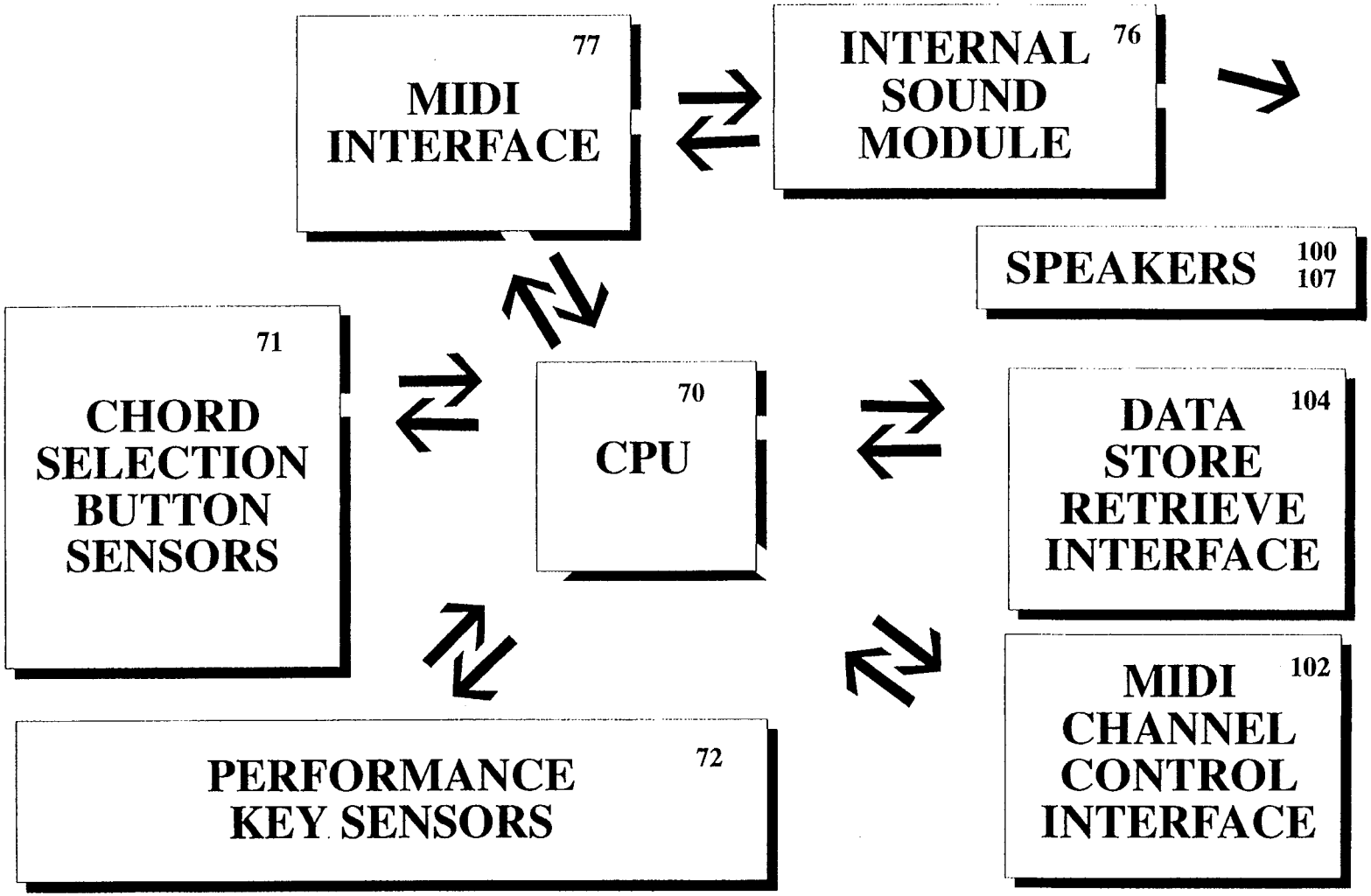
Figure 9:
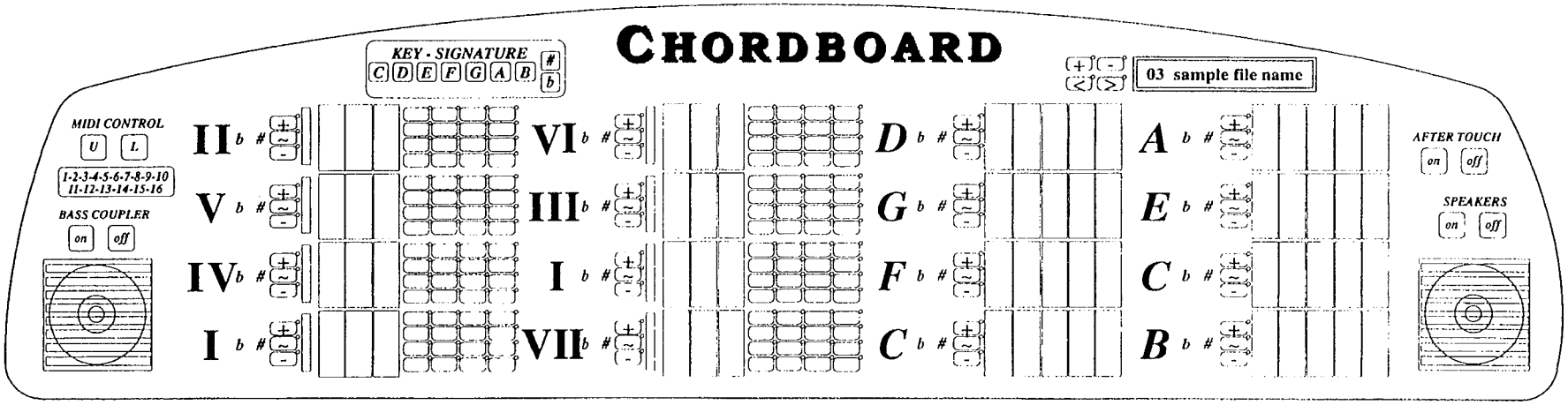

FIG. 5 details the chord selection buttons, bass clef performance keys, and adjacent controls FIG. 6 details the treble clef performance keys, and adjacent controls FIG. 7 details three examples using the Chord Board set-up file controls FIG. 8 shows a data flow chart of the CPU interaction with other major components within the Chord Board FIG. 9 official gazette illustration of Chord Board suitable for reduction

| Reference Numerals in Drawings |
|---|
| 10-Octave Up Bass Clef Selection Switch |
| 11-Octave Normal Bass Clef Selection Switch |
| 12-Octave Down Bass Clef Selection Switch |
| 13-Pitch Bend Wheel Controller |
| 14-Left Hand or Base Clef Performance Key #1 |
| 15-Left Hand or Base Clef Performance Key #2 |
| 16-Left Hand or Base Clef Performance Key #3 |
| 17-Chord Selection Major Toggle Switch |
| 18-Chord Selection Minor Toggle Switch |
| 19-Chord First Inversion Toggle Switch |
| 20-Chord Second Inversion Toggle Switch |
| 21-SUS4 Chord Selection Toggle Switch |
| 22-Fifth Chord Selection Toggle Switch |
| 23-Seventh Chord Selection Toggle Switch |
| 24-Eleventh Chord Selection Toggle Switch |
| 25-Diminished Chord Toggle Switch |
| 26-Augmented Chord Toggle Switch |
| 27-Quartal Chord Toggle Switch |
| 28-Chord Third Inversion Toggle Switch |
| 29-Ninth Chord Selection Toggle Switch |
| 30-Sixth Chord Selection Toggle Switch |
| 31-Option Toggle Switch |
| 32-Thirteenth Chord Selection Toggle Switch |
| 33-Lighted Toggle Switch On/Off Indicator |
| 40-Chord Family Name Indicator |
| 41-Lighted Key Signature Indicator |
| 42-Octave Up Treble Clef Selection Switch |
| 43-Octave Normal Treble Clef Selection Switch |
| 44-Octave Down Treble Clef Selection Switch |
| 45-Treble Clef Performance Key #1 |
| 46-Treble Clef Performance Key #2 |
| 47-Treble Clef Performance Key #3 |
| 48-Treble Clef Performance Key #4 |
| 49-Treble Clef Performance Key #5 |
| 60-Plus button |
| 61-Minus button |
| 62-Cursor left control button |
| 63-Cursor right control button |
| 64-Electronic view area |

-continued

| Reference Numerals in Drawings |
|---|
| 70-Central Processing Unit |
| 71-Chord selection button sensors |
| 72-Performance Key sensors |
| 76-Internal sound module |
| 77-MIDI interface |
| 100-Left speaker |
| 101-Bass Coupler toggle |
| 102-MIDI channel control selection |
| 103-Key Signature selection |
| 104-Chord Set-Up file control |
| 105-After Touch Toggle |
| 106-Speakers On/Off switch |
| 107-Right speaker |
| 110-Treble clef performance keys for A Chord family |
| 112-Treble clef performance keys for E Chord family |
| 114-Treble clef performance keys for C Chord family |
| 116-Treble clef performance keys for B Chord family |
| 120-Treble clef performance keys for D Chord family |
| 122-Treble clef performance keys for G Chord family |
| 124-Treble clef performance keys for F Chord family |
| 126-Treble clef performance keys for C Chord family |
| 130-Chord selection buttons for A Chord family |
| 132-Chord selection buttons for E Chord family |
| 134-Chord selection buttons for C Chord family |
| 136-Chord selection buttons for B Chord family |
| 140-Bass clef performance keys for A Chord family |
| 142-Bass clef performance keys for E Chord family |
| 144-Bass clef performance keys for C Chord family |
| 146-Bass clef performance keys for B Chord family |
| 150-Chord selection buttons for A Chord family |
| 152-Chord selection buttons for E Chord family |
| 154-Chord selection buttons for C Chord family |
| 156-Chord selection buttons for B Chord family |
| 160-Bass clef performance keys for D Chord family |
| 162-Bass clef performance keys for G Chord family |
| 164-Bass clef performance keys for F Chord family |
| 166-Bass clef performance keys for C Chord family |

DESCRIPTION OF—FIGURES 1-7

FIG. 1 and FIG. 2

Figure 1:
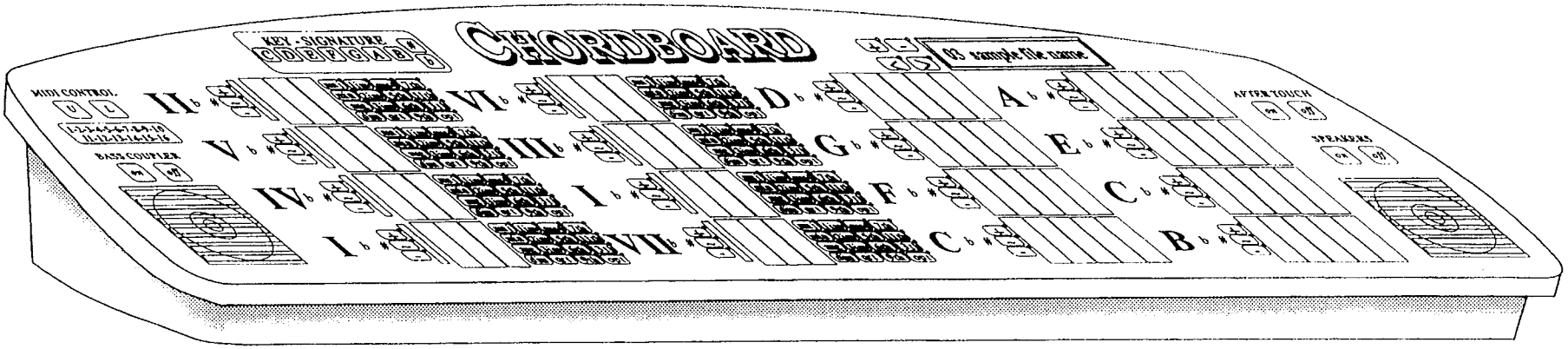
FIG. 1 shows a three-dimensional oblique view of the Chord Board
Figure 2:
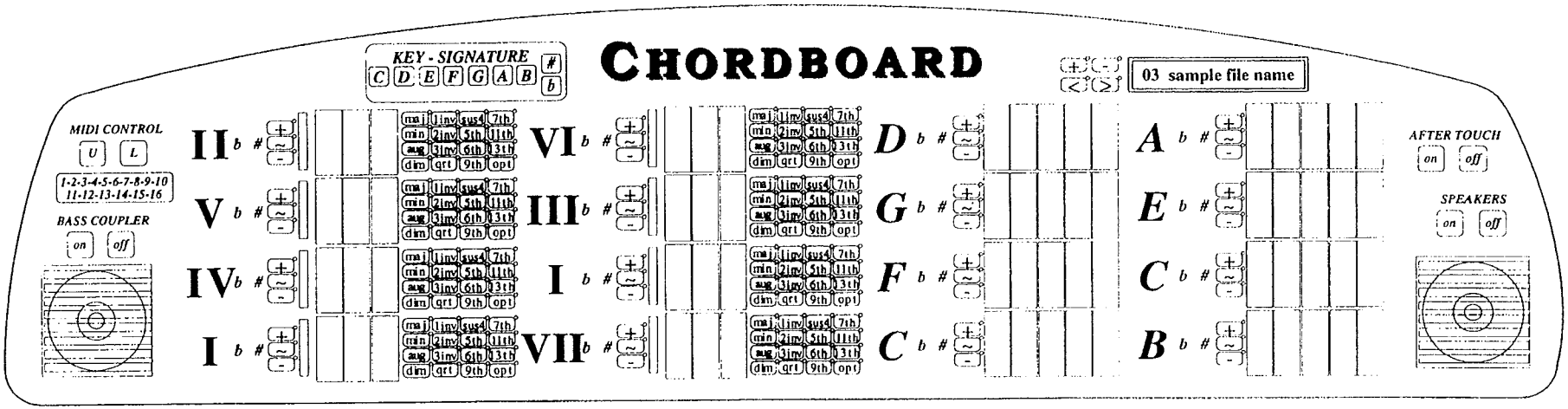
FIG. 2 shows the same Chord Board as viewed from the top

A typical embodiment of the present musical invention is illustrated in FIG. 1 (3D view) and FIG. 2 (top view). This particular embodiment has a keyboard interface with a key/button layout as shown so that the chord functions can be accessed dynamically and effectively in a play-performance situation.

The embodiment of the Chord Board shown in FIGS. 1, and 2 has several components which, when combined together, provide the process that forms the basis for this invention.

FIG. 3

FIG. 3 shows the general main groups of sub groups on the Chord Board interface which include the following:

a) a key signature selection bank identified by an encircled "KSK,"

b) an octave selection switch bank identified by an encircled "OCT,"

c) a pitch bend controller identified by an encircled "PBC,"

d) bass clef performance keys identified by an encircled "BPK,"

e) treble clef performance keys identified by an encircled "TPK,"

f) chord selection switches identified by an encircled "CSB,"

g) analog internal speaker identified by an encircled "SKR,"

h) a chord set-up file control identified by and encircled "FIL,"

and other various controls for MIDI channel, speaker on/off control, as well as after touch options.

The purpose of FIG. 3 is to show broad logical groupings of the minor elements or sub-groups of the Chord Board. These sub-groupings will be identified and further detailed in FIG. 4 which follows. FIG. 5 and FIG. 6 will detail the function of the parts, shown as groups of parts in FIG. 4.

FIG. 4

This figure illustrates several components of the Chord Board, as well as some logical groupings of common parts described in detail within FIG. 5 and FIG. 6.

100 Left speaker. This speaker will voice the left channel of the internal sound module.

101 Bass Coupler toggle. This option is for the novice musician that can not yet coordinate the use of two hands in performance. The purpose of this function is to provide a voicing of a note two octaves below the root of the chord being played on the treble clef performance keys 110–126. By so doing, the chord sounds richer and fuller with a dimension of bass in the chord group without needing to play any of the bass clef performance keys 140–146, 160–166.

102 MIDI channel control selection. This section provides for the assignment of output and input MIDI channels for various sections of the Chord Board. This control interface allows for the independent assignment of a MIDI channel to the Bass Clef Performance Keys 140–146, 160–166 as well as to the Treble Clef Performance Keys 110–126.

103 Key Signature selection. This section provides for the assignment of any particular key signature to be imposed upon the Chord Board. When a key signature is selected, the Chord Board chord state is altered to conform to the key signature selected. This is simply the activation of the major or minor chord selection toggle switch for all eight chord family groups.

104 Chord Set-Up file control. This section provides for the storage and retrieval of Chord Board chord state information. When utilized, this feature will allow the present status of all chord selection buttons to be saved as a whole, so that this information may easily be retrieved at a later time such as during a live performance. It is possible to save 100 different states, each with a unique associated name, such as the name of a song. This feature is very useful to minimize the pressing of buttons during a performance or just prior to beginning to play a song using the Chord Board.

105 After Touch Toggle. This feature allows for the transfer of after touch MIDI information as desired. After touch MIDI information is extremely data intensive, and is therefore an option as to its use.

106 Speakers On/Off switch. This switch enables or disables the internal sound module system. When using the Chord Board as a MIDI controller for the playing of sound modules external to the Chord Board via a MIDI interface, it may be desirable to disable the internal sound function of the Chord Board.

107 Right speaker. This speaker will voice the right channel of the internal sound module.

110 Treble clef performance keys for A Chord family. These five keys play only note pitches associated with the A chord family according to the chord structure selected using the chord selection buttons 130.

112 Treble clef performance keys for E Chord family. These five keys play only note pitches associated with the E chord family according to the chord structure selected using the chord selection buttons 132.

114 Treble clef performance keys for C Chord family. These five keys play only note pitches associated with the C chord family according to the chord structure selected using the chord selection buttons 134.

116 Treble clef performance keys for B Chord family. These five keys play only note pitches associated with the B chord family according to the chord structure selected using the chord selection buttons 136.

120 Treble clef performance keys for D Chord family. These five keys play only note pitches associated with the D chord family according to the chord structure selected using the chord selection buttons 150.

122 Treble clef performance keys for G Chord family. These five keys play only note pitches associated with the G chord family according to the chord structure selected using the chord selection buttons 152.

124 Treble clef performance keys for F Chord family. These five keys play only note pitches associated with the F chord family according to the chord structure selected using the chord selection buttons 154.

126 Treble clef performance keys for C Chord family. These five keys play only note pitches associated with the C chord family according to the chord structure selected using the chord selection buttons 156.

130 Chord selection buttons for A Chord family. These buttons control the note pitch assignments or chord structure that will be used on the treble clef performance keys 110 and the bass clef performance keys 140.

132 Chord selection buttons for E Chord family. These buttons control the note pitch assignments or chord structure that will be used on the treble clef performance keys 112 and the bass clef performance keys 142.

134 Chord selection buttons for C Chord family. These buttons control the note pitch assignments or chord structure that will be used on the treble clef performance keys 114 and the bass clef performance keys 144.

136 Chord selection buttons for B Chord family. These buttons control the note pitch assignments or chord structure that will be used on the treble clef performance keys 116 and the bass clef performance keys 146.

140 Bass clef performance keys for A Chord family. These three keys play only note pitches associated with the A chord family according to the chord structure selected using the chord selection buttons 130.

142 Bass clef performance keys for E Chord family. These three keys play only note pitches associated with the E chord family according to the chord structure selected using the chord selection buttons 132.

144 Bass clef performance keys for C Chord family. These three keys play only note pitches associated with the C chord family according to the chord structure selected using the chord selection buttons 134.

146 Bass clef performance keys for B Chord family. These three keys play only note pitches associated with the B chord family according to the chord structure selected using the chord selection buttons 136.

150 Chord selection buttons for D Chord family. These buttons control the note pitch assignments or chord structure that will be used on the treble clef performance keys 120 and the bass clef performance keys 160.

152 Chord selection buttons for G Chord family. These buttons control the note pitch assignments or chord structure that will be used on the treble clef performance keys 122 and the bass clef performance keys 162.

154 Chord selection buttons for F Chord family. These buttons control the note pitch assignments or chord structure that will be used on the treble clef performance keys 124 and the bass clef performance keys 164.

156 Chord selection buttons for C Chord family. These buttons control the note pitch assignments or chord structure that will be used on the treble clef performance keys 126 and the bass clef performance keys 166.

160 Bass clef performance keys for D Chord family. These three keys play only note pitches associated with the D chord family according to the chord structure selected using the chord selection buttons 150.

162 Bass clef performance keys for G Chord family. These three keys play only note pitches associated with the G chord family according to the chord structure selected using the chord selection buttons 152.

164 Bass clef performance keys for F Chord family. These three keys play only note pitches associated with the F chord family according to the chord structure selected using the chord selection buttons 154.

166 Bass clef performance keys for C Chord family. These three keys play only note pitches associated with the C chord family according to the chord structure selected using the chord selection buttons 156.

FIG. 5

FIG. 5 illustrates the detail of the bass clef performance keys 14–16, the chord selection switches 17–32, and the associated controls 10–13. Also identified is a typical toggle switch on/off indicator 33 which is adjacent to each toggle switch on the Chord Board. This grouping of parts with reference numerals 10–33 is a common group, repeated in eight different locations on the Chord Board as will be described in FIG. 4.

The main part of this section of the Chord Board are the chord selection toggle switches identified by reference numerals 17–32. These buttons as well as the pitch controls 10–13 define how the performance keys 14–16 will respond in pitch. These parts are described as follows:

10 Octave up toggle switch. When activated, the note pitch of all performance keys 14–16 will respond an octave higher than the default.

11 Octave default toggle switch. When activated, the note pitch of all performance keys 14–16 will respond according to the default.

12 Octave down toggle switch. When activated, the note pitch of all performance keys 14–16 will respond an octave lower than the default.

13 Pitch bend control. This spring-loaded wheel when rotated will cause the note pitch of all performance keys 14–16 to bend up or down depending on the direction it is rotated.

14 Base Clef Performance Key #1. This key plays the first note of the chord group selected. This note is the root of the chord unless a modifier toggle is also selected, such as one of the inversion 19, 20, 28 buttons.

15 Base Clef Performance Key #2. This key plays the second note of the chord group selected. This note is by default a fifth interval higher than key #1 14.

16 Base Clef Performance Key #3. This key plays the third note of the chord group selected. This note is by default the note an octave higher than key #1 14.

17 Major chord toggle switch. When activated, the chord grouping will conform to the major scale of the key signature being played.

18 Minor chord toggle switch. When activated, the chord grouping will conform to the minor scale of the key signature being played.

19 First inversion chord toggle switch. When activated, the chord grouping will conform to the 1st inversion.

20 Second inversion chord toggle switch. When activated, the chord grouping will conform to the 2nd inversion.

21 Sus4 chord toggle switch. When activated, the performance keys 14–16 will conform to the Sus4 chord grouping.

22 Fifths chord toggle switch. When activated, the performance keys 14–16 will conform to the 5ths chord grouping.

23 Sevenths chord toggle switch. When activated, the performance keys 14–16 will conform to the 7ths chord grouping.

24 Elevenths chord toggle switch. When activated, the performance keys 14–16 will conform to the 11ths chord grouping.

25 Diminished modifier toggle switch. When activated the interval quality of an interval within the chord group will be changed by lowering the pitch of the top note a half step on the musical scale.

26 Augmented modifier toggle switch. When activated the interval quality of the fifth or fourth interval within the chord group will be changed by raising the pitch of the top note a half step on the musical scale.

27 Quartal chord toggle switch. When activated the performance keys 14–16 will conform to play note pitches along the quartal chord grouping.

28 Third inversion chord toggle switch. When activated, the chord grouping will conform to the 3rd inversion

29 Ninth chord toggle switch. When activated, the performance keys 14–16 will conform to the 9ths chord grouping.

30 Sixth chord toggle switch. When activated, the performance keys 14–16 will conform to the 6ths chord grouping.

31 Option chord toggle switch. A reserve key for future functionality.

32 Thirteenth chord toggle switch When activated, the performance keys 14–16 will conform to the 13ths chord grouping.

33 Light adjacent to a toggle switch to indicate the on/off status of the toggle switch.

FIG. 6

This figure illustrates the section of the Chord Board referred to as the treble clef performance keys 110–126. This grouping of parts with reference numerals 40–49 is a common group, repeated in eight different locations on the Chord Board designated as 110–126 in FIG. 4

40 This symbol or label is the chord family name indicator. It is one of the seven notes in the major scale comprising C, D, E, F, G, A, and B.

41 These are lighted symbols that indicate whether the chord family 40 key signature is sharp or flat. This is controlled by the Key Signature Selection Keys shown in FIG. 3.

42 Octave up toggle switch. When activated, the note pitch of all performance keys 45–49 will respond an octave higher than the default.

43 Octave default toggle switch. When activated, the note pitch of all performance keys 45–49 will respond according to the default.

44 Octave down toggle switch. When activated, the note pitch of all performance keys 45–49 will respond an octave lower than the default.

45 Treble Clef Performance Key #1. This key plays the first note of the chord group selected. This note is the root of the chord unless a modifier toggle is also selected, such as one of the inversion 19, 20, 28 buttons. This note is two octaves higher than the bass clef performance key #1 14.

46 Treble Clef Performance Key #2. This key plays the second note of the chord group selected. This note is by default a third interval higher than key #1 45.

47 Treble Clef Performance Key #3. This key plays the third note of the chord group selected. This note is by default a fifth interval higher than key #1 45.

48 Treble Clef Performance Key #4. This key plays the fourth note of the chord group selected. In the case of a triad this key plays a note pitch an octave higher than key #1 45.

49 Treble Clef Performance Key #5. This key plays the fifth note of the chord group selected. In the case of a chord group with only four pitch classes this key plays a note pitch an octave higher than key #1 45. In the case of a triad chord this key plays a note pitch an octave higher than key #1 46.

FIG. 7

This figure shows the Data Storage and Retrieval user interface 104, shown with three examples.

FIG. 8

This figure shows the interaction or relation of the Central Processing Unit (CPU) to the other major components of the Chord Board. The internal sound module is not directly controlled by the CPU, but receives information from the MIDI interface. It is essentially an external device contained internal to the Chord Board cabinet. This is an advantage, because upgrades to the sound module at future dates and as they improve is a very simple process since the module is not a part of the CPU board.

OPERATION—FIGURES 1 to 8

The Chord/Board is designed to be played with both hands, as most musical instruments are. FIG. 4 shows several logical groupings of the finer parts of the Chord Board. To provide some understanding of how this instrument is to be played and operated, reference to FIG. 4 is necessary.

Key Signature

The first step one would take in approaching the Chord Board would be to select the key signature desired. All written musical compositions are written in a particular key signature such as C, Ab, or G#, etc. The key signature selection section of the Chord Board is identified by 103 on FIG. 4, and has push button switches for each note of the major scale. If the key signature of a particular musical composition were in the key of Eb, then one would first press the E button and then press the b button to set the Chord Board into the Eb key signature. By so doing, all of the chord family groups are put into a mode compatible with the particular key signature selected. In this example the key of Eb has three flats (Ab, Bb, and Eb). Each chord family group on the Chord Board will then default to a major or minor chord structure.

For example, in the C chord family group, a major triad consists of the notes C, E, and G. This happens to occur when it is played in the key of C because there are no sharps or flats in this key signature. But in the key of Eb there exists an E flat, therefore, the C chord triad would consist of the notes C, Eb, and G which is a C minor triad. So when the key signature of Eb is selected, the C chord family group controls (126, 156, & 166) are set up to default with the minor chord selection button 18 (within 156) activated. This will cause the E to be played flat as per the Eb key signature selected. All other chord families will conform to the Ab, Bb, and Eb in a similar manner, causing either the major 17 or the minor 18 chord selection button within each of the chord family selection buttons 130–136, 150–156 to be activated. The activation of 17 or 18 depends on whether the triad chord of the family is major or minor as a result of the key signature.

In summary, the main purpose of the key signature selection 103 area is to place the Chord Board default chord selection status compatible with the key signature. This minimizes the need for the musician to manually do this for each of the chord family group's chord selection buttons 130, 132, 134, 136, 150, 152, 154, and 156.

Selecting a Chord The musician would next place their hands in a position to play the first chord of the musical composition. The Chord Board has been designed so that the left hand would operate the areas shown on FIG. 4 numbered 130–166. The right hand would play the areas of the Chord Board identified with numerals 110–126.

The hands would be placed over the performance keys belonging to the chord family which represents the first chord of the musical composition. For example, if the chord progression for the first four bars of a song with four beats per bar were C, Eb, Ab, and then back to C, the musician would first place their right hand over the C chord family treble clef performance keys 114. The left hand would be placed over the bass clef performance keys for the C chord family 144, as well as the chord selection buttons for the same chord family 134. The bass clef performance keys are limited in number to three, so that the thumb and index fingers of the left hand may dynamically access the chord selection buttons 134 during performance as needed.

It should be noted here that there are two sets of the C Chord family on the Chord Board (114, 134, 144 as one and 126, 156, 166 as the other). This was designed to make it more convenient to move the hands a shorter distance from one chord family to the next, and since the C chord family is very commonly used. The first group was selected in this example because it is closer to the next chord family in the chord progression for the song, namely, the E chord family 112, 132, and 142. The hands will only need to move a minor distance to play the performance keys for the next chord in the song.

Once the hands are in place, the next step is to select the type of chord structure that is desired within the C chord family. This is done by pressing one or more of the chord selection buttons 156 with the thumb or index finger. In this example, the first chord of the song will be a C minor 7th chord. Because the key signature was selected as Eb, the minor chord toggle switch 18 for the C chord family group 134 is already active (see FIG. 5 for detail) and need not be pressed. The musician then presses the chord selection button labeled as 7th 23 and then proceeds to play the performance keys 114 and 144 with the left and right hands as desired.

Chord Board Set-Up of Chords

If desired, the musician may set up the Chord Board prior to beginning a performance to play the types of chord structures desired for each chord family used within the chord progression. For example, if it is known that the chord progression will be a C minor 7th, an Eb major 7th, and Ab sus4, and then back to a C minor 7th, then these chord structures may be manually selected in the following manner. The C chord family could be put into the 7ths mode by pressing the 7th chord selection button 23 within the C chord family group of buttons 134. The E chord family would be put into the 7ths mode by pressing the 7th chord selection button 23 within the E chord family group of buttons 132. The A chord family would be put into the sus4 mode by pressing the sus4 button 21 within the A chord family group of buttons 130. Once this is done, and if there are to be no departures from these chord structures, then the musician is able to play a performance from chord to chord without the worry of selecting chord structures during performance.

This particular set up or state may be saved within the Chord Boards internal memory with an associated name or title. The Chord Board is designed to save 100 user-selectable states each having a unique name or title. These are saved and accessed with the set-up feature 104 by pressing the associated keys to type in the name or title.

Playing the Performance Keys

There are five treble clef performance keys and three bass clef performance keys within each chord family. This provides maximum control over the voicing of each note of the chord group ( human element) as will become apparent in the example that follows:

Continuing with the previous example of playing a chord progression of C, Eb, Ab, and C in 4/4 time, the musician then begins to play one or more of the C chord family performance keys 114 with the right hand and 144 with the left hand for the first bar. Them is much flexibility in how the chord will sound depending on which keys the musician decides to play, and what kind of rhythm or syncopation will be employed during each bar. Each performance key plays a unique note within the chord group selected as defined in the static descriptions of FIG. 5 and FIG. 6 for the performance keys 14, 15, 16, 45, 46, 47, 48, and 49. As a by-product of the uniqueness of each performance key (no two keys play the same note) the musician has the power to introduce the human element into the voicing of chords. There is unlimited variety in how the chord will be voiced.

An example of the human element as it relates to the voicing of the notes with the performance keys follows. The musician may choose to play the bass clef performance key #1 14 and play it hard holding it for 1½ beats, then play the key again softly for a ½ beat duration, and then again hard for a half note (or one note held for two beats) duration within the first bar of music. Each note may be played with a different volume depending on how hard the key was played, giving the musician the ability to accent certain beats. This particular example is a typical rock beat, with the first beat loud, then soft. The left hand rhythm and performance is completely subjective, and is even optional. The right hand may play a third interval within the chord group by pressing the 2nd 46 and 3rd 47 treble clef performance keys on the up beat immediately following the first note played by the left hand 14. All other performance keys 45, 48, 49 would not be used in the first bar of music for this example. An alternative to playing a third interval would be to play a seventh interval by pressing the 1 st 45 and 4th 48 keys on the same up beat. Yet another alternative for the right hand would be to play the 1st 45, 2nd 46, 3rd 47, and 4th 48 keys in unison to play the complete minor seventh chord group. The possibilities and combinations of rhythms and notes that may be played or omitted in any chord group on the Chord Board is limited only by one's imagination. This freedom of expression is essentially the human element, which is extremely important to serious musicians. To non-serious musicians alike, the Chord Board makes it simple to play a good performance, since there are no wrong notes to be played. Every note played on the keys 45, 46, 47, 48, 49 within the chord group is a legitimate note within the chord selected and will not sound like a mistake if played.

(Continuing with the previous example . . . ) The first bar of music is now complete and the hands must move to the next chord family group in the chord progression, the Eb chord. While the foot pedal sustains the notes for the C chord notes just played (just as in a typical keyboard performance), the right hand moves from the C keys 114 to the E keys 112. The left hand may stay at the same C keys 144 for the second bar and play what is known as a pedal tone that does not change throughout the four bars, or the left hand may follow the right hand and move to the E chord keys 142 also. Either way is an acceptable musical expression, and both are possible with the Chord Board. Keeping with the 7th chord structure used in the C chord, 7ths will also be used for the Eb chord in this example. The musician then presses the 7th chord button 23 within the E chord family group 132, immediately preceding the use of the performance keys 112 and 142 for the E chord.

Once the second bar of music is expressed by the musician, the hands move up from the E keys (112 and 142) to the A keys (110 and 140). Up to this point in the song, the Chord Board has been set to play sevenths for the C and Eb chords. Rather than play another 7th chord structure for the Ab chord, the musician may want some variety and choose to play say, and Ab SUS4 chord. This is done by pressing the SUS4 chord selection button 21 within the A chord family group 130, and then playing the notes of the chord on the performance keys 110 and 140. After the performance for the third bar of music is complete, the hands would return to the C chord group keys (114 and 144) to play the fourth bar of music.

FIG. 7

This data storage and retrieval interface is actually a very powerful feature of the Chord Board. The current state or status of the chord selection buttons 130–136, 150–156 can be saved within the Chord Boards internal memory for recall at a later time. This feature is especially useful in a live performance situation where is may not be practical from a time standpoint, to make chord selections. It would be as simple as pressing the plus 60 or minus 61 keys to select the saved status information, and then play the Chord Board.

The Chord Board status is saved to the internal memory by selecting a memory location with the plus 60 or minus 61 keys, and then using the right cursor key 63 or left cursor key 62 to move to a desired single digit location within the electronic view area 64. After moving the cursor to the desired digit location, then the plus 60 or minus 61 keys are used to select a letter of the alphabet in a sequential fashion. After the letter is selected, the cursor keys 62 63 would be used to select another single digit location, then a letter selected in the same manner, until all letters have been chosen for the title. After the title is complete, the information may be saved permanently by pressing both cursor keys 62 63 simultaneously.

After the information has been saved, it can be instantly recalled by merely selecting the memory location with the plus 60 or minus 61 keys. When the memory location is accessed in this manner, the status of the chord board is returned to the state that existed just before it was saved with the title shown in the electronic view area 64. The purpose of this feature is to essentially to provide a set of user-defined presets for the Chord Board.

FIG. 8

This figure shows the interaction or relation of the Central Processing Unit (CPU) 70 to the other major components of the Chord Board. The CPU contains the programming instructions to effectively route all keypress and button-press information to perform its intended function conforming to this specification.

The internal sound module 76 is not directly controlled by the CPU 70, but receives information from the MIDI interface 77. The sound module 76 is essentially an external device contained internal to the Chord Board casing. This is an advantage, because upgrades to the sound module 76 at future dates is a very simple process since the module is not a part of the CPU 70 board. It is designed so that the MIDI interface 77 has an additional output jack to directly feed to the sound module 76. The analog output from the sound module is directed to the internal speaker system 100,107.

The chord selection button sensors 71 are the electronic relay circuit that make the connection from the chord selection buttons 130–136, 150–156 to the CPU 70. Each one of these sensors 71 are located directly beneath and in a position to make contact with each of the chord selection buttons 130–136, 150–156.

The performance key sensors 72 are the electronic switches that make the connection from the performance keys 110–116, 120–126, 140–146, 160–166 to the CPU 70. Each one of these switches 72 are located directly beneath and in a position to make direct contact with each of the performance keys 110–116, 120–126, 140–146, 160–166. The switches 72 are capable of detecting the velocity of the key-press action.

The MIDI channel control interface 102 provides the means for the musician to route the available 16 input and 16 output MIDI channels as desired. Or in other words, it is possible to manually assign the Chord Board to listen to and broadcast on a specific channel other than channel 1 which is the default. It is also possible to split the keyboard so that, for instance, the bass clef performance keys 140–146, 160–166 will broadcast on say, channel 4, and the treble clef performance keys 110–116, 120–126 may broadcast on channel 6. In this manner the bass clef performance keys may play a specific sound such as a bass guitar, and the treble clef performance keys could play an electric piano sound.

The data store retrieve interface 104 allows for the access to up to 100 different Chord Board set-ups. This feature allows instant access and configuration of the Chord Board chord selection buttons 130–136, 150–156.

Summary, Ramifications, and Scope

Accordingly, the reader will see that this new musical instrument invention, the Chord Board, has the potential to revolutionize the way music is played. It puts the power of complex chord playing capability into the hands of the average musician. The ability to own what one plays because of the human element utility provided for within this invention, makes the Chord Board all the more attractive to those who take joy in truly expressing themselves musically.

Furthermore, the Chord Board has several more advantages in that

- a person with small hands as well as little or no previous skill level can play meaningful and musically as well as rhythmically interesting chord patterns;
- a person with advanced chord playing skill on a piano-style keyboard can still benefit from the increased ease and functionality that the Chord Board provides pertaining to syncopation and arpeggiation with the performance keys;
- a person with the desire to arrange musical scores, but with little technical knowledge pertaining to chords will be able to easily construct an accompaniment to a melody using the Chord Board, because the correct chord structure can be quickly ascertained by a trial and error process using one's ear, while pressing alternative chord selection buttons within the same chord family;
- it is not possible to play a wrong note within any chord group using the performance keys because all keys are mapped to a particular note within the chord group selected and will sound musically correct;
- there are no unused keys, because the performance keys are mapped to specific notes within the chord group, essentially making the distance between notes of the chord only one key apart from each other, whereas on a typical piano keyboard the individual notes of a chord may be two, three, four or more keys apart from each other;
- this musical instrument combines high computer technology with the ease of performance, providing for a new level of creative synergy with musical expression that will result in more abundant musical genius. New ideas will spring from this newfound capability.

While the above description contains many specificities, these should not be construed as limitations on the scope of the invention, but rather as an exemplification of one preferred embodiment thereof. Many other variations are possible. For example:

Another potential embodiment of the present invention would associate the chord selection toggles with foot pedal controls instead of these being accessed by the hands. All other features of the invention remaining the same.

Yet another potential embodiment of the present invention would be to have voice-activated control over the chord selection process instead of hand access or foot pedal control. All other features of the invention remaining the same.

Yet another embodiment of the present invention would be to decrease or increase the number of performance keys or chord selection keys. Another potential embodiment would be to slightly modify the keys to include a black key between each performance key, thereby adding the ability to play a half step note pitch above or below each note within the chord group.

Another potential embodiment of the invention would be to arrange the performance keys and chord selection buttons in a manner entirely different than the embodiment described in this specification, yet would provide the same kind of functionality for a different kind of playing or performance preference. The keys could be oriented in a more vertical fashion, essentially creating eight rows of chord families with two columns of performance keys, instead of four rows of chord families with two sets of two columns of performance keys.

Because there are so many different ways that the Chord Board could be constructed or designed, the scope of the invention should be determined by the appended claims and their legal equivalents, rather than by the examples given.

I claim:

1. An electronic musical instrument comprising:

a) a plurality of sets of performance key groups (BPK and TPK) and chord selection toggle switches (CSB) which are electronically linked together as a unit (BPK-CSB-TPK), and each grouping of BPK, CSB and TPK located adjacent to one another so as to facilitate the playing of the BPK set and CSB panel with say, the left hand, and the TPK set with the right hand wherein each electronically/physically associated BPK-TPK-CSB unit is independent from all other BPK-TPK-CSB units within the same musical instrument, wherein each said BPK-TPK-CSB unit employs a plurality of BPK's and TPK's to play one or more of the notes within a user selectable chord grouping, wherein each said individual BPK and TPK plays a note unique from all other said BPK's and TPK's within said performance key group, and each CSB panel may be used to provide continuously variable means to alter interval and quality of selected chord group for said set of BPK's and TPK's, wherein said CSB panel may be used to alter the note assignment for it's associated BPK and TPK set, whereby the chord interval, quality, octave or scale may be selected and altered instantly and dynamically during a musical performance, b) a microprocessor used to sample the status and activity of said electronic BPK-TPK-CSB unit at regular intervals for the purpose of generating digital musical information, c) a data transfer interface electronically connected to said microprocessor that facilitates the transfer of musical data obtained and generated by said microprocessor to and from an external communication device, such as a sound module.

2. The musical instrument of claim 1 wherein said data transfer interface conforms to the musical instrument digital interface (MIDI) protocol standard.

3. The musical instrument of claim 1 containing a group of key signature selection toggle switches which are used to choose a desired key signature which in turn alters the state of BPK-CSB-TPK units to conform to the key signature selected.

4. The musical instrument of claim 1 which has an electronic data storage and retrieval device user interface.

5. The musical instrument of claim 1 wherein said chord selection toggle switches contain a light to indicate an activated state.

6. The musical instrument of claim 1 wherein said performance keys are illuminated.

7. The musical instrument of claim 1 wherein said performance keys are grouped similarly within each of the seven chord families found within the major or minor musical scales comprised of the musical notes A, B, C, D, E, F, and G.

8. The musical instrument of claim 1 wherein said performance keys are velocity sensitive.

9. The musical instrument of claim 1 wherein said performance keys for left hand are in groups of three and said performance keys for right hand are in groups of five for each said performance key and chord selection toggle switch set.

10. The musical instrument of claim 1 wherein said chord selection toggle switches are comprised of:

a) a major/minor scale selection toggle switch, b) an augmented modifier selection toggle switch, c) a diminished modifier selection toggle switch, d) a inversion modifier toggle switch, e) an interval modifier toggle switch, for each said performance key and chord selection toggle switch set.

11. The musical instrument of claim 1 wherein said chord selection toggle switches are comprised of:

a) a major scale selection toggle switch, b) a minor scale selection toggle switch, c) an augmented modifier selection toggle switch, d) a diminished modifier selection toggle switch, e) a 1st inversion modifier toggle switch, f) a 2nd inversion modifier toggle switch, g) a 3rd inversion modifier toggle switch, h) a quartal chord selection toggle switch, (a chord wherein all notes are separated by intervals of seven half steps), i) a sus4 chord selection toggle switch, j) a 5th interval chord selection toggle switch, k) a 6th interval chord selection toggle switch, l) a 7th interval chord selection toggle switch, m) a 9th interval chord selection toggle switch, n) a 11th interval chord selection toggle switch, o) a 13th interval chord selection toggle switch, p) and an option chord selection toggle switch (provided to allow for optional switching of default chord family to another chord family)

for each said performance key and chord selection toggle switch set.

12. The musical instrument of claim 1 having a case of rigid material which will accommodate the joining of BPK-CSB-TPK units.

13. The musical instrument of claim 12 wherein said case of rigid material also contains said key signature selection toggle switches, said data storage and retrieval user interface, said data communications user interface, a removable sound module, a set of speakers, a plurality of said microprocessors, and said data transfer interface within a single enclosure.

14. The musical instrument of claim 13 having a sound module that is electronically interfaced (permanent) with said microprocessor (through other than the MIDI interface) and capable of producing analog or digital sounds in response to the activation of said BPK-CSB-TPK unit.

15. The musical instrument of claim 13 having a plurality of amplified speakers used to voice the output signal from said sound module.

* * * * *